United States Patent [19]

Eisen et al.

[11] 4,220,309

[45] Sep. 2, 1980

[54] METHOD AND APPARATUS FOR POSITIONING HANGING DEVICES ON A WALL

[75] Inventors: Harry Eisen, 16421 Chatsworth St., Granada Hills, Calif. 91344; Walter D. Kimmelman, Chatsworth, Calif.

[73] Assignee: Harry Eisen, Granada Hills, Calif.

[21] Appl. No.: 954,315

[22] Filed: Oct. 24, 1978

[51] Int. Cl.[2] ..... F16M 13/00; A47G 1/17; A47G 1/20

[52] U.S. Cl. ..... 248/542; 248/544; 248/546; 248/547; 248/467; 33/180 R; 248/1

[58] Field of Search ..... 248/1, 467, 489, 495, 248/497, 542, 544, 546, 547; 33/174 G, 180 R

[56] References Cited

U.S. PATENT DOCUMENTS

| | | | |
|---|---|---|---|
| 3,031,159 | 4/1962 | Waller | 245/544 X |
| 3,516,165 | 6/1970 | Pfeffer | 33/180 R |
| 3,530,591 | 9/1970 | Moffitt | 33/174 G X |
| 3,853,226 | 12/1974 | Hine et al. | 248/489 X |

*Primary Examiner*—William H. Schultz

*Attorney, Agent, or Firm*—Fulwider, Patton, Rieber, Lee & Utecht

[57] ABSTRACT

For use with a frame to be hung on a wall by one or more attachment devices on the frame each engaging a hanging device on the wall, a method and apparatus for positioning one or more hanging devices on the wall is provided which includes an elongated body having a tab for engaging the attachment device. The body is generally flat and arranged to be releasably secured to the frame on one side, and after the frame has been located at a desired position on the wall, the opposite side of the body can be releasably secured to the wall. A portion of the body is arranged to identify a point on the wall where each hanging device is to be located in order that the frame will hang in the desired position.

19 Claims, 19 Drawing Figures

METHOD AND APPARATUS FOR POSITIONING HANGING DEVICES ON A WALL

BACKGROUND OF THE INVENTION

This invention relates generally to the art of hanging pictures, mirrors and the like on a wall, and more particularly, to an apparatus for positioning a hanging device on a wall so that the picture will hang in a desired location. Since objects to be hung on a wall generally include a frame by which they are supported, the object to be hung by employing the present invention will be referred to hereinafter as a frame. Of course, this invention is equally applicable for use in hanging objects that do not include a frame, such as sconces, objects of art, and the like.

As is well known in the art, it is highly desirable to be able to locate a frame on a wall in the precise position chosen. This is difficult, however, because a variety of attachment devices, such as cords, sawtooth brackets or eye-type attachments, can be located at different places on the frame, and generally are hidden from view behind the frame when the frame is being moved about and positioned on a wall.

With the frame held at its desired position upon a wall, present methods for identifying the point at which a hanging device should be secured to the wall require complicated measuring or marking procedures. These procedures must take into account all of the factors of positioning, including vertical and horizontal placement, size and shape of the frame, location of the unseen cord or other attachment device, and estimation of the position that the attachment device will assume when holding the frame.

The procedure for properly locating a hanging device becomes more complicated when two or more nails, hooks or other hanging devices are used. Employing dual or multiple hanging devices greatly increases the stability of a hanging frame over the use of a single hanging device, thus minimizing slippage, tilt, or other undesirable positions of a hanging frame. However, locating the precise points for securing dual or multiple hanging devices to a wall, properly spaced and in the same horizontal plane, presently requires the special abilities of highly skilled professionals or laymen with similar capabilities.

Accordingly, there has existed a need for a convenient and effective apparatus for identifying the point or points at which a hanging device should be secured to a wall in order to support a frame at a precise preselected position. Further, there has existed a need for such an apparatus that can be applied while the frame is conveniently at rest upon a floor or other suitable surface with its attachment means exposed and reachable. As will become apparent from the following, the present invention satisfies these needs.

SUMMARY OF THE INVENTION

The present invention resides in a new and improved method and apparatus for positioning hanging devices on a wall, and by which a positioning apparatus is releasably secured first to a frame to be hung on the wall, and then to the wall. Upon removing the frame from the apparatus, the point or points for locating the hanging devices are easily identified. Moreover, the apparatus of the present invention is relatively inexpensive to manufacture, is trouble free and reliable in use, and can be provided with preattached hanging devices to enhance the convenience of its use.

More specifically, the apparatus of the present invention includes a generally elongated body usually having at least one tab for engaging an attachment device on a frame. The body is arranged to be releasably secured to the frame on one side, and similarly arranged to be releasably secured to the wall on the other side. A portion of the body can include one or more apertures or other suitable means for identifying the points on a wall where hanging devices are to be located in order that the frame will hang in a preselected position.

The arrangement for releasably securing the body to the frame can be a longitudinally disposed adhesive strip, and an adhesive patch disposed adjacent one end of the body can be provided for releasably securing the body to the wall. The portion of the device for identifying the point at which a hanging device is to be secured can be detachable from the body and include a preattached hanging device such as a conventional picture hook. Further, the apparatus of the present invention can simultaneously identify the points at which two or more hanging devices should be attached to a wall for the purpose described above.

Other features and advantages of the present invention will become apparent from the following detailed description, taken in conjunction with the accompanying drawings, which illustrate, by way of example, the principles of the invention.

DETAILED DESCRIPTION

As shown in the exemplary drawings, the present invention is embodied in a method and apparatus for positioning one or more hanging devices on a wall in order to hang a frame with precision in a desired location. The present apparatus can be used in connection with any attachment device on the frame, such as a cord, sawtooth bracket, eye or the like, and the apparatus can be employed for positioning any desired hanging device, such as a nail, picture hook or the like.

In accordance with the present invention, a method for positioning a hanging device on a wall, and an apparatus for performing the method, are provided by which a positioning apparatus is secured to a frame to be hung on the wall, and after the frame is moved to a desired position on the wall, the device is transferred from the frame to the wall, whereupon the device identifies a point on the wall where the hanging device is to be located. If desired, the hanging device can be preattached to the positioning apparatus to enhance the convenient use of the apparatus. Moreover, the apparatus of the present invention is relatively inexpensive to manufacture, is trouble free and reliable in use, and can be arranged to position a plurality of hanging devices simultaneously.

Figure 1:
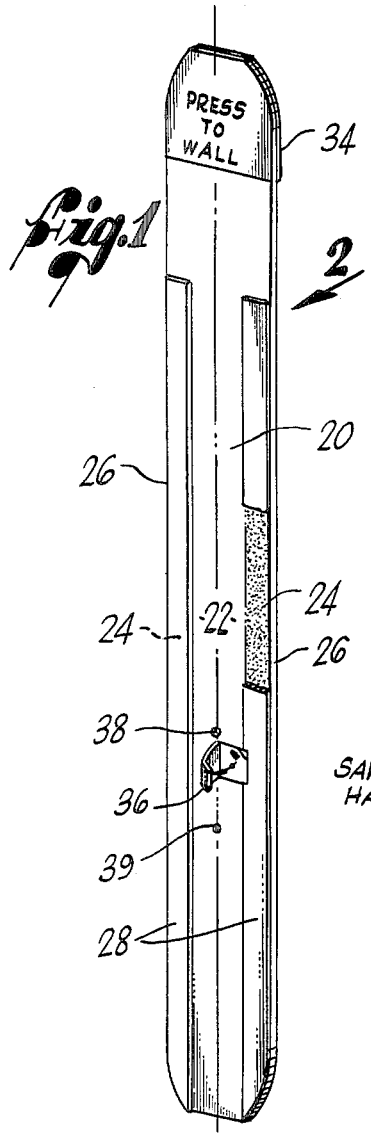
FIG. 1 is a perspective view of a positioning apparatus embodying the present invention and taken generally from the obverse side thereof.
Figure 2:
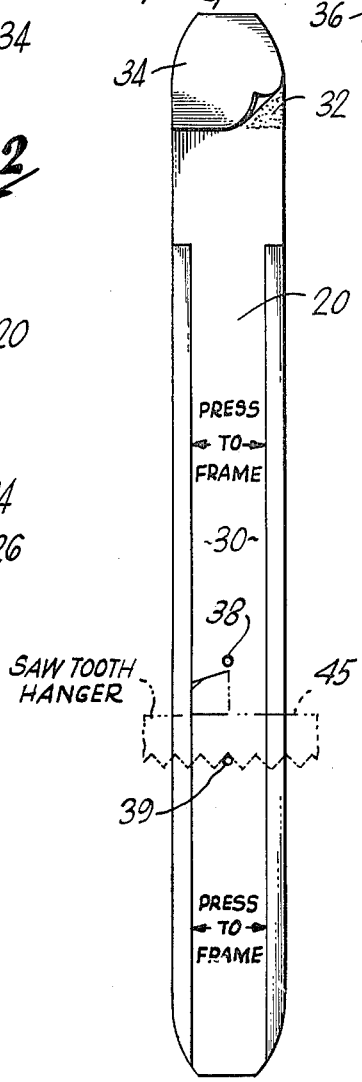
FIG. 2 is an elevational view of the reverse side of the positioning apparatus of FIG. 1.

One embodiment of the apparatus of the present invention is illustrated, for example, in FIGS. 1 and 2. The apparatus is formed of a generally flat, elongated body 20 having an obverse side 22 (FIG. 1) including a means for releasably securing the body to a frame (not shown). In this instance, the securing means is a pair of adhesive strips 24, each disposed longitudinally along a lateral edge 26 of the body 20. The adhesive strips 24 can be conventional double-sided adhesive tape.

In order to permit the body 20 to be secured to the frame in substantially any position along the length of the body 20, the adhesive strips 24 extend from the bottom of the body nearly to the top thereof. Further, for the purpose of facilitating the handling of the apparatus before use, a removable cover 28 can be placed over each adhesive strip 24 and peeled away prior to use of the apparatus. For purposes of illustration, a portion of the removable cover 28 has been broken away to reveal the adhesive strip 24.

As can best be seen in FIG. 2, the reverse side 30 of the body 20 includes an adhesive patch 32 adjacent the top of the body 20. The adhesive patch 32 can also be covered with a removable cover 34 which can be peeled away prior to use of the apparatus.

The body 20 can be formed of a cardboard material or any other lightweight and suitably rigid material such as plastic. A tab 36 can be pre-cut in the central portion of the elongated body 20 and folded when desired to a position substantially perpendicular to the body and projecting from either the obverse or reverse side as indicated by the arrow in FIG. 1. A first aperture 38 is formed through the body from the obverse to the reverse side adjacent to and immediately above the tab 36, and a second aperture 39 can be formed through the body below the tab 36.

Figure 3:
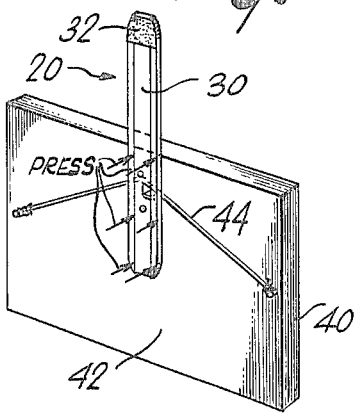
FIG. 3 is a reduced perspective view of the positioning apparatus of FIG. 1, and illustrated as used in connection with a frame having a cord for hanging the frame.

When in use in conjunction with a frame 40, the removable covers 28 and 34 are removed from the apparatus. When the obverse side 22 facing the back surface 42 of the frame 40, the body is moved to a position where the tab 36 engages an attachment device in a position for hanging the frame 40, and as illustrated in FIG. 3, the attachment device is a cord 44. The cord preferably passes between the body 20 and frame 40 as shown, with the tab 36 extending from the obverse side 22. The device can also be used by engaging the cord 44 over the tab 36 extending from the reverse side 30, but the cord must then be removed from the tab before positioning the frame on the wall as described below.

If the apparatus is used in connection with a sawtooth attachment device, the tab 36 can be folded through the body 20 to project from the reverse side 30 for engaging the attachment device. In this instance, the body 20 can be inserted between the sawtooth bracket 45 (shown in phantom line in FIG. 2) and the frame 40 so that the bottom edge of the tab 36 engages the top of the bracket 45. In this position, the aperture 39 will be located adjacent to and immediately below the sawtooth edge of the bracket 45 for a purpose which will be described hereinafter.

With the body 20 in the position illustrated in FIG. 3, the body can be secured to the back surface 42 of the frame 40 by pressing along the lateral edges of the reverse side 30 of the body 20 as indicated by the arrows in FIG. 3. The adhesive strips 24 will retain the body 20 in position on the frame 40. Further, as can best be seen in FIG. 1, the tab 36 is preferably curved slightly so that if the tab should contact the back surface of the frame, it will fold back toward or into the body as contact occurs.

Figure 4:
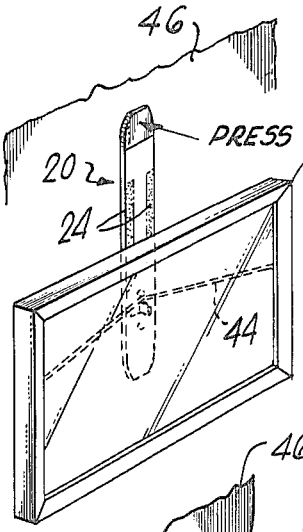
FIG. 4 is a perspective view of the frame and positioning device of FIG. 3, and illustrated with the frame located in a desired position on a wall.
Figure 5:
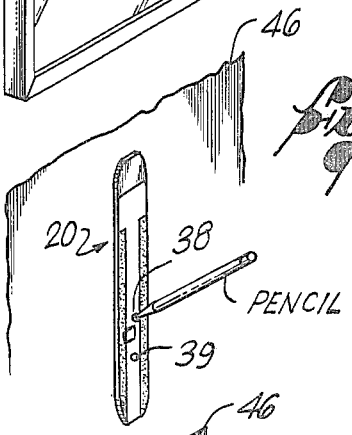
FIG. 5 is a perspective view of the positioning apparatus of FIG. 4, and illustrated with the frame removed and in a position for identifying a point on the wall for locating a hanging device.

The frame 40, carrying the body 20, can now be moved to any desired location on a wall 46 (FIG. 4), and the body can be transferred to the wall 46 by pressing at the top of the body opposite the adhesive patch 32, as indicated by the arrow in FIG. 4. With the body thus secured to the wall 46 by the adhesive patch 32, the frame 40 can be separated from the adhesive strips 24 leaving the body 20 secured in place and exposed upon the wall 46, as shown in FIG. 5. In this position, a mark 48 can be made on the wall through either the aperture 38 or 39 by any suitable device such as a pencil, as illustrated.

Figure 6:
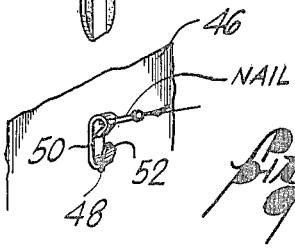
FIG. 6 is a perspective view of a hanging device mounted on a wall at the location identified by the apparatus of FIG. 5.

After removing the body 20 from the wall 46, the mark 48 can be used to locate a hanging device 50 in the proper position on the wall 46 for hanging the frame 40 in the preselected position. As illustrated in FIG. 6, the hanging device 50 is a conventional picture hook which is secured to the wall 46 by a nail such that the hook portion 52 of the device 50 coincides with the mark 48 on the wall. It should be noted that any hanging device 50, such as a nail, can be employed so long as it is attached to the wall with its cord or other attachment engaging portion coinciding with the mark 48.

Figure 7:
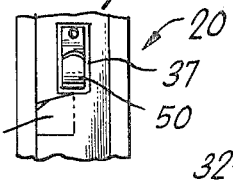
FIG. 7 is a fragmentary view of an alternative embodiment of the present invention illustrating a rectangular aperture sized to locate a conventional picture hook.

If desired, the small aperture 38 can be replaced by a larger rectangular opening 37 (FIG. 7) sized to receive, for example, a conventional picture hook. By this arrangement, the picture hook can be properly located on the wall 46 without requiring any marking.

An alternative embodiment of the present invention, illustrated in fragmentary views 8 and 9, is distinguished from the embodiment illustrated in FIGS. 1 and 2 in that no tab 36 is required, and the aperture 38 is replaced by a longitudinally disposed series of spaced apertures 38' extending from the bottom of the body 20' to nearly the top thereof. In this instance, the body 20' is similar to the apparatus previously discussed in connection with FIGS. 1 and 2, and parts of the apparatus of FIGS. 10 and 11, which find substantial correspondence in structure and function to those previously discussed in connection with FIGS. 1 and 2, have been designated with corresponding primed reference numerals.

Figure 9:
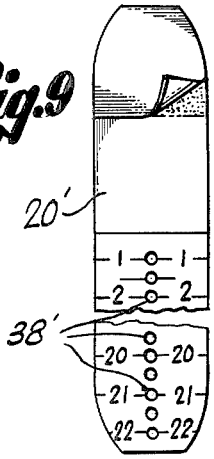
FIG. 9 is a fragmentary elevational view of the reverse side of the positioning apparatus of FIG. 8.
Figure 8:
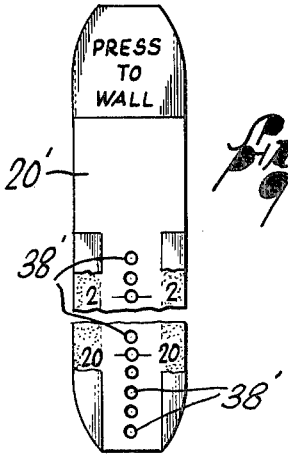
FIG. 8 is a fragmentary elevational view of the obverse side of an alternative embodiment of a positioning apparatus embodying the present invention.

The apertures 38' are numbered sequentially along the obverse side of the body 20', as illustrated in FIG. 8, and each aperture is marked on the reverse side (FIG. 9) with the same number designation by which that aperture is designated on the obverse side. By this arrangement, the obverse side of the body 20' can be secured to the back surface 42 of a frame 40 in the same manner as discussed in connection with FIG. 3. The cord 44 is then moved to the position which it would assume if the frame 40 were hanging therefrom, and the number designation of the aperture 38' nearest the cord 44, or other attachment means, is duly noted.

Thereafter, upon moving the frame 40 to the desired location on the wall 46, transferring the body 20' to the wall 46 and removing the frame 40 therefrom, a mark 48 can be made at the proper position on the wall 46 by marking through the aperture 38' bearing the above noted number designation. A hanging device 50 can then be secured to the wall 46 as discussed above in connection with FIG. 6.

Figure 10:
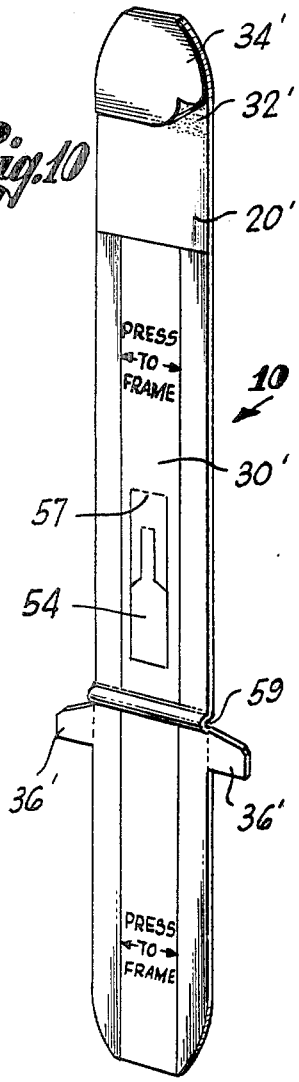
FIG. 10 is a perspective view of the reverse side of another alternative embodiment of a positioning apparatus embodying the present invention.
Figure 11:
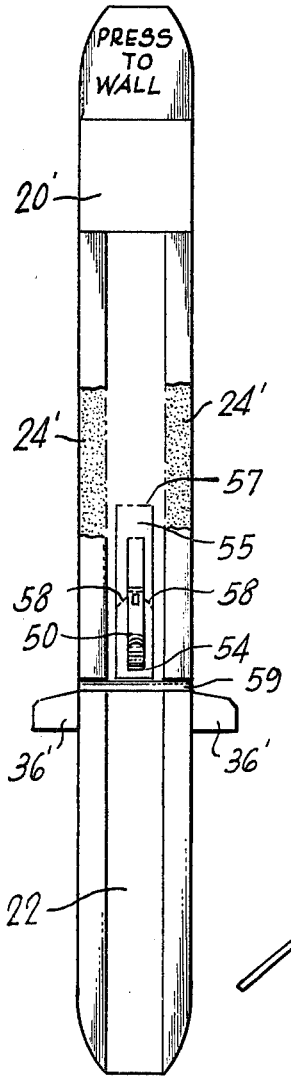
FIG. 11 is an elevational view of the obverse side of the positioning apparatus of FIG. 10.

Another alternative embodiment of the present invention is illustrated in FIGS. 10 and 11. The body 20' includes a pair of attachment engaging tabs 36', and a hanging device 50 is preattached to a detachable portion 54 of the body 20' by any suitable means such as an adhesive. Alternatively, if the apparatus is constructed of a molded plastic, the hanging device 50 can be molded as a unitary part of the detachable portion 54 and body 20'.

Figure 12:
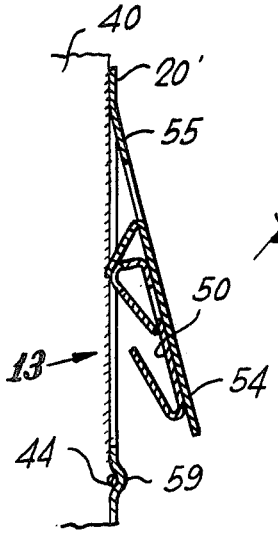
FIG. 12 is an enlarged fragmentary partly sectional view of a hanging device secured to the positioning apparatus of FIG. 10, and illustrated with the positioning apparatus secured to a frame.
Figure 14:
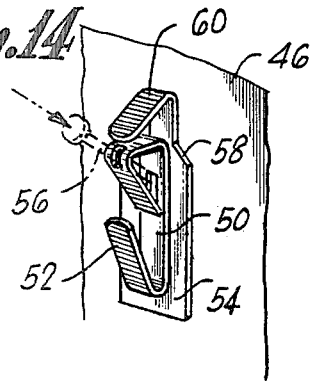
FIG. 14 is an enlarged perspective view of the hanging device of FIGS. 10 through 13, and illustrated as secured to the wall with the positioning apparatus removed therefrom.

Since the hanging device 50 projects forwardly from the obverse side 22', the portion 54 to which the device 50 is attached must be arranged to move rearwardly in order to permit the adhesive strips 24' to be secured to the frame 40, as can best be seen in FIG. 12. For this purpose, the detachable portion 54 can be attached to the body 20' by a depending tab 55 which is arranged to fold rearwardly of the body 20' along a crease 57, and the portion 54 is secured to the tab 55 only along a pair of perforated or partially severed edges 58 (FIGS. 11 and 14). Further, since the cord 44 passes between the body 20' and the frame 40, a recess 59 can be provided since the body between the tabs 36' to accommodate the cord 44 when the body is secured to the frame (FIG. 12).

Figure 13:
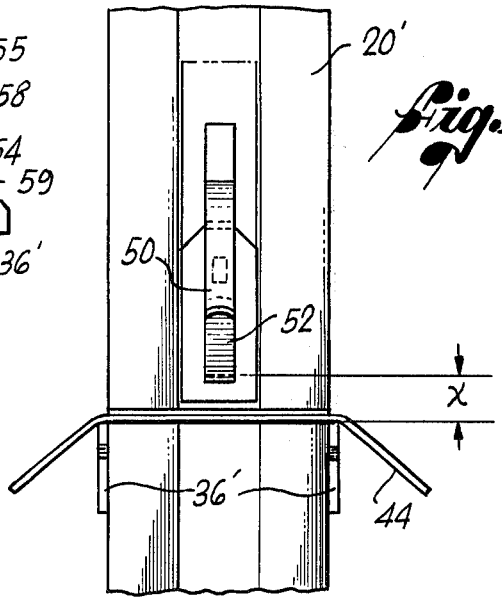
FIG. 13 is a fragmentary elevational view of the hanging device and positioning apparatus of FIG. 12, taken generally in the direction of the line 13 in FIG. 12, and illustrating the apparatus as used in connection with a frame suspending cord.

When a pair of laterally spaced tabs 36' are employed in place of a single tab 36, the cord engaging edge of the tabs 36' must be spaced a short longitudinal distance X below the hook 52 of the device 50, as illustrated in FIG. 13. This longitudinal spacing is required due to the change in angularity of the cord 44 when disposed across two retaining means rather than the single hook 52. Accordingly, it will be appreciated that a greater lateral spacing between the tabs 36' will require a greater longitudinal spacing as represented by the dimension X in FIG. 13.

When using the apparatus of FIGS. 10 and 11, the body 20' is located on and secured to the wall 46 in the same manner as described in connection with FIGS. 3 and 4 above. However, the marking step previously described is not required since a hanging device is preattached to the body 20' in a position for hanging the frame 40 at the desired location on the wall 46.

Accordingly, the device 50 can simply be secured to the wall 46 with a nail 56 or other suitable securing means (FIG. 14), and the body 20' can be removed from the wall leaving the detachable portion 54 secured between the hanging device 50 and the wall 46. For this purpose, the detachable portion 54 breaks away from the tab 55 along the perforated or partially severed edges 58. An advantage of this arrangement is that the detachable portion 54 behind the hanging device 50 will serve to protect the wall 46 from cracking or chipping during the securing of the device or in the event that the nail 56 should be removed at some later time.

Figure 15:
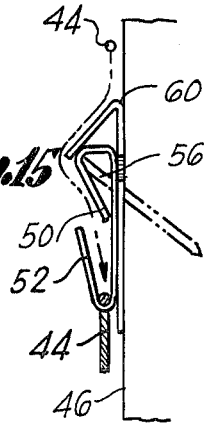
FIG. 15 is a right side elevational view of the hanging device of FIG. 14, and illustrating the engagement of the hanging device with a frame suspending cord.

As can best be seen in FIGS. 14 and 15, the detachable portion 54 is formed at its upper end with an extension 60 forming a downward sloping cap above the hanging device 50. The extension 60 thereby serves to prevent the frame attachment cord 44 from inadvertently engaging the top of the hanging device 50 instead of the hook portion 52 when hanging the frame 40, as indicated by the dotted line path in FIG. 14.

Another alternative embodiment of the present invention is illustrated in FIGS. 16 and 17, and again, parts of the apparatus of FIGS. 16 and 17 which find substantial correspondence in structure and function to those previously discussed in connection with FIGS. 1 and 2 have been designated with correspondence primed reference numerals. In this instance, the apparatus is arranged for hanging a frame 40 at a desired location from a pair of laterally spaced hanging devices 50.

Toward this end, the body 20' includes a pair of laterally extending wings 62 each having a hanging device 50 secured to a detachable portion 54' in a manner similar to that discussed in connection with FIGS. 10 and 11 above. The obverse side 22' is arranged with an adhesive strip 24' and removable cover 28', and the reverse side 30' includes an adhesive patch 32' and removable cover 34' for the purposes discussed in connection with FIGS. 3 and 4 above. Of course, the hanging devices 50 could be replaced with simple apertures (not shown) for marking the wall 46, or with a larger rectangular aperture, as discussed in connection with FIGS. 5 and 7 above, or with any other suitable guide means for identifying the proper location for the hanging devices, such as a printed image of a hanging device, or the like.

Figure 16:
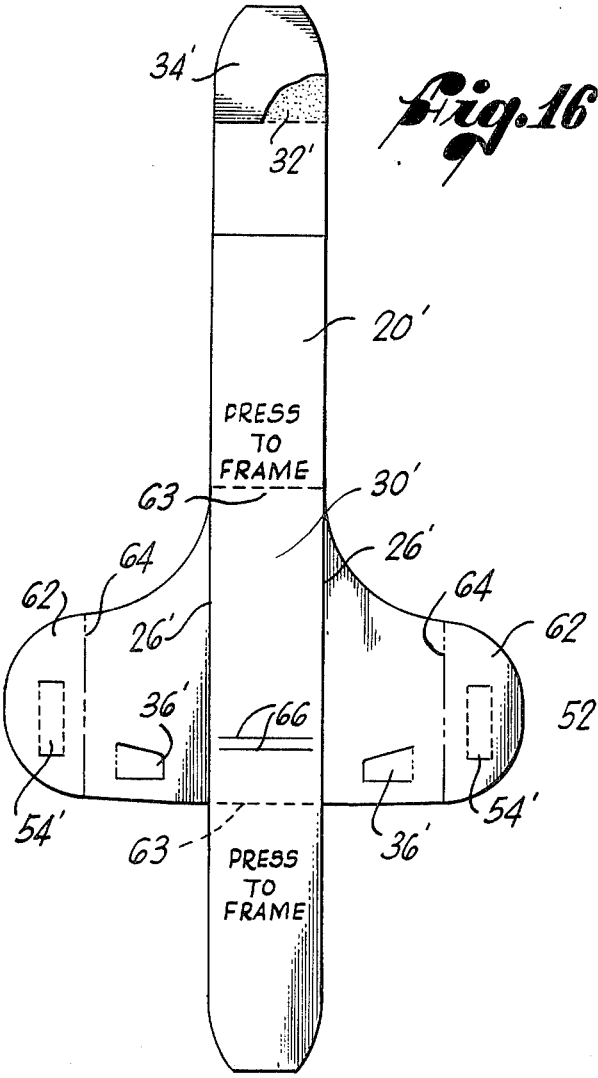
FIG. 16 is an elevational view of the reverse side of another alternative embodiment of the present invention arranged to position a pair of hanging devices on a wall.

The laterally extending wings 62 can be formed integrally with the body 20', or the lateral wings can be formed separately and be removably secured to an elongated vertical body 20' by any suitable means, such as an adhesive. This latter arrangement is illustrated in FIG. 16 by the solid lines 26', indicating the lateral edges of the elongated body 20', and the broken lines 63, indicating that the wings 62 are detachable from the body 20' so that the positioning device is formed generally of a two-piece construction. By this arrangement, a single elongated body 20' can be reused with a plurality of sets of laterally extending wings 62.

It should be noted that the pair of tabs 36', being spaced laterally inwardly from the hanging devices 50, are spaced a small longitudinal distance above the hook portions 52 of the devices 50 to compensate for the angularity of the cord 44, as discussed above in connection with FIG. 13. Also, the tabs 36' are again curved slightly so that they will fold back into the body upon contacting the back surface 42 of the frame 40.

Figure 17:
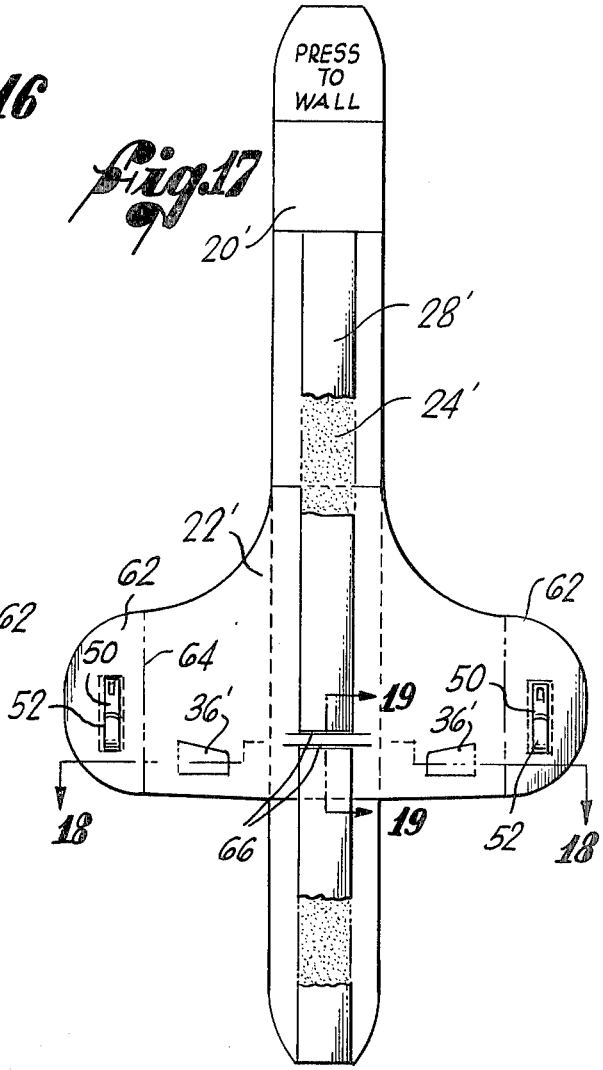
FIG. 17 is an elevational view of the obverse side of the apparatus of FIG. 16.
Figure 18:
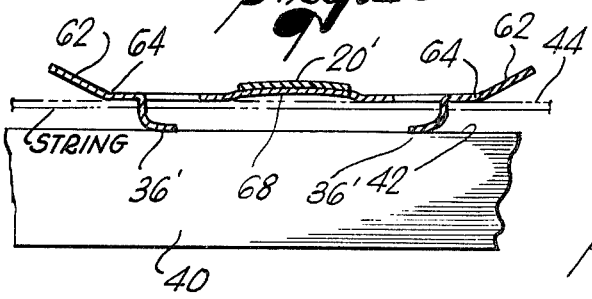
FIG. 18 is a sectional view of the apparatus of FIGS. 16 and 17 taken substantially along the line 18—18 in FIG. 17, and illustrating the apparatus as used in connection with a frame supporting cord.
Figure 19:
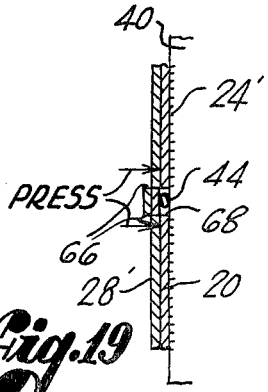
FIG. 19 is a fragmentary partly sectional view of a portion of the apparatus of FIGS. 16 and 17 taken substantially along the line 19—19 in FIG. 17, and illustrating the apparatus as used in connection with a frame and frame supporting cord.

As can best be seen in FIG. 17, the laterally extending wings 62 are arranged to be folded rearwardly along a line 64 so that the body 20' can be secured to the back surface 42 of the frame 40 without interference by the hanging devices 50. Further, a pair of horizontally disposed slits 66 are arranged across the adhesive strip 24' to provide a recess 68 (FIG. 18) to accommodate the cord 44 when the strip 24' is secured to the back surface 42 of the frame 40. If the wings 62 are formed separately and detachable, as described above, the slits 66 are cut through both the body 20' and the lateral member supporting the wings 62.

From the foregoing, it will be appreciated that the present invention provides a method and apparatus by which a frame 40 can be easily and conveniently located at any desired position on a wall 46 without requiring any complicated measuring or marking techniques. Further, the body 20 can be fabricated conveniently and economically of a lightweight and inexpensive material, the apparatus is adaptable for use with any kind of attachment device or hanging device, and the apparatus can be arranged for hanging the frame 40 from a pair of laterally spaced hanging devices 50.

While several particular forms of the invention have been illustrated and described, it will also be apparent that various modifications can be made without departing from the spirit and scope of the invention.

I claim:

1. An apparatus for positioning a hanging device on a supporting surface in a position to hang a frame at a desired location on said supporting surface, said apparatus comprising:

a generally flat elongated body having an obverse and a reverse side;

means on said body for aligning said body with respect to an attachment device on said frame;

means on said obverse side for securing said body to said frame;

means on said reverse side for securing said body to said supporting surface; and means on said body for identifying a position on said supporting surface at which said hanging device is to be located for engaging said attachment device on said frame, and thereby hanging said frame at said desired location.

2. An apparatus as set forth in claim 1 wherein said means for aligning said body with respect to said attachment device is a tab projecting from said body in a plane substantially perpendicular to said body and arranged to engage said attachment device.

3. An apparatus as set forth in claim 1 wherein said means for securing said body to said frame includes a longitudinally disposed adhesive strip.

4. An apparatus as set forth in claim 1 wherein said means for securing said body to said supporting surface includes an adhesive patch disposed adjacent one end of said body.

5. An apparatus as set forth in claim 1 wherein said means for identifying said position on said supporting surface is an aperture extending through said body from said obverse to said reverse side adjacent to and above said engaging means.

6. An apparatus as set forth in claim 1 wherein said means for identifying said position on said supporting surface is an aperture extending through said body from said obverse to said reverse side adjacent to and below said engaging means.

7. An apparatus as set forth in claim 1 wherein said means for identifying said position on said supporting surface is an aperture extending through said body from said obverse to said reverse side, said aperture being of sufficient size and shape to receive said hanging device therethrough.

8. An apparatus as set forth in claim 1 wherein said means for identifying said position on said supporting surface is a series of apertures extending through said body from said obverse to said reverse side, said series of apertures being arranged longitudinally on said body, and each aperture having an identifying mark on said obverse side and an identical identifying mark on said reverse side.

9. An apparatus as set forth in claim 1 wherein said means for identifying said position on said supporting surface is a portion of said body arranged to be detached from said body and secured to said supporting surface, said portion having said hanging device secured thereto.

10. An apparatus as set forth in claim 1 wherein said means for aligning said body with respect to said attachment device is a pair of laterally spaced tabs projecting from said body in a plane substantially perpendicular to said body, and spaced longitudinally from said means for identifying said position on said supporting surface.

11. An apparatus as set forth in claim 1 wherein said means for identifying said position on said supporting surface is a pair of laterally spaced portions of said body.

12. An apparatus as set forth in claim 1 wherein said means for identifying said position on said supporting surface is a pair of laterally spaced portions formed integrally with each other and separately of said body, and arranged to be releasably secured to said body.

13. An apparatus as set forth in claim 11 or 12 wherein each of said laterally spaced portions is arranged to be detached from said body and secured to said supporting surface, and each of said portions includes a hanging device secured thereto.

14. An apparatus as set forth in claim 9 wherein said hanging device is formed as a unitary part of said detachable portion of said body.

15. An apparatus as set forth in claim 9 wherein said detachable portion is arranged to be movable rearwardly of said body.

16. An apparatus as set forth in claim 9 wherein said detachable portion of said body includes a downwardly and outwardly sloping portion disposed above and covering the top of said hanging device.

17. An apparatus as set forth in claim 10 including a laterally disposed recess in said obverse side of said body between said laterally spaced tabs.

18. A method for positioning a hanging device on a supporting surface in a position for hanging a frame at a desired location on said supporting surface, said frame having an attachment means, said method comprising the steps of:

orienting a point on an elongated object in a fixed position with respect to said attachment means;

securing said object to said frame in said fixed position;

positioning said frame at said desired location on said supporting surface;

securing said object to said supporting surface;

removing said frame from said object; and positioning said hanging device at a point on said supporting surface identified by said point on said elongated object.

19. A method as set forth in claim 18 further characterized by:

orienting a pair of laterally spaced points on an elongated object in a fixed position with respect to said attachment means; and positioning a hanging device at each of a pair of laterally spaced points on said supporting surface identified by said pair of laterally spaced points on said elongated object.

* * * * *

UNITED STATES PATENT AND TRADEMARK OFFICE

CERTIFICATE OF CORRECTION

PATENT NO. : 4,220,309

DATED : September 2, 1980

INVENTOR(S) : Harry Eisen et al.

It is certified that error appears in the above—identified patent and that said Letters Patent is hereby corrected as shown below:

Column 6, line 2, "since" should read -- across --.

Signed and Sealed this

*Twenty-fifth* Day of *November 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,220,309

DATED : September 2, 1980

INVENTOR(S) : Harry Eisen and Walter D. Kimmelman

It is certified that error appears in the above—identified patent and that said Letters Patent is hereby corrected as shown below:

Column 4, line 23, delete "When" and insert -- With --

Signed and Sealed this

*Third* Day of *February 1981*

[SEAL]

*Attest:*

RENE D. TEGTMEYER

*Attesting Officer*

*Acting Commissioner of Patents and Trademarks*